United States Patent [19]

Weir

[11] Patent Number: 4,729,181

[45] Date of Patent: Mar. 8, 1988

[54] LAUNDRY FEEDER

[76] Inventor: Henry J. Weir, Bulwark, Chepstow, Gwent NP6 5QK, Great Britain

[21] Appl. No.: 893,355

[22] Filed: Sep. 29, 1986

Related U.S. Application Data

[63] Continuation-in-part of Ser. No. 697,842, Feb. 3, 1985, abandoned.

[30] Foreign Application Priority Data

Mar. 2, 1984 [GB] United Kingdom ..... 8402909

[51] Int. Cl.[4] ..... D06F 67/04

[52] U.S. Cl. ..... 38/143; 271/276

[58] Field of Search ..... 38/1.4, 143, 8; 406/82; 26/88; 271/276

[56] References Cited

U.S. PATENT DOCUMENTS

| | | | |
|---|---|---|---|
| 3,436,853 | 4/1969 | Buss | 38/143 |
| 3,483,645 | 12/1969 | Gilmore | 38/143 |
| 3,553,863 | 6/1969 | Sjostrom | 38/143 |
| 3,657,832 | 4/1972 | Valentine | 38/143 |
| 3,667,143 | 6/1972 | Hall | 38/143 |
| 3,909,964 | 10/1975 | Wenck | 38/143 |
| 4,388,750 | 6/1983 | Engels | 38/143 X |

*Primary Examiner*—Andrew M. Falik

*Attorney, Agent, or Firm*—Russell E. Hattis; Stephen R. Arnold

[57] ABSTRACT

A laundry feeding machine features a conveyor moving through a suction induction tunnel. Articles are held at their upper edges by an automatically releasing clamp to hang in front of the induction tunnel. Upon release of the clamp, a valving system is immediately actuated to apply suction to suck the article in to lie flat on the conveyor to be transported thereby. In one version of the invention, a nip roller based at the outlet of the system engages the leading edge of each article as it passes through, whereupon the valving system is actuated to suck the remainder of the article into a suction chamber having a smoothing blade at the entrance port thereof, so that as the article is drawn out of the suction chamber by the nip roller, a smoothing action occurs. A system of computer-controlled valve actuators responsive to properly laced photosensors governs all valving operations automatically. The system is adaptable by means of one or more movable partition blades to be reconfigurable to a parallel multi-path feeding system having independent valves and photosensors.

29 Claims, 14 Drawing Figures

LAUNDRY FEEDER

RELATED APPLICATIONS

This application is a continuation-in-part of U.S. Application Ser. No. 647,842 filed Feb. 3, 1985, abandoned the contents of which are incorporated by reference herein.

TECHNICAL FIELD

The invention relates to equipment for feeding laundry articles onto a conveyor system from which they are fed into subsequent processing machinery, such as ironing machines, folding machines, or the like.

BACKGROUND OF THE INVENTION

The basic requirements for feeding flat, rectangular fabric articles, such as bed sheets, pillow cases, towels, etc., onto a conveyor are: (1) a loading position in front of the conveyor where the leading edge portion of an article can be placed manually or automatically; and (2) a transfer mechanism which feeds the leading edge portion of the article from the loading position and onto the conveyor, leaving the loading position free and ready to receive the leading edge portion of the next article.

The existing and known methods which are employed at present comprise devices which draw the leading edge portion of the article mechanically onto the conveyor or which blow the article onto the conveyor by means of air streams from pressure jets. Both of these systems have limitations of speed, complexity, or quality of feeding.

In more detail, such systems normally place mechanisms of one sort or another immediately between the operator and the leading edge of the conveyor, and it is frequently extremely difficult, if not dangerous, for the operator to attempt to insert an article by manual emplacement on the conveyor. This greatly reduces the flexibility of the system, and in particular tends to reduce the maximum transfer rate. U.S. Pat. No. Re 31,453 reissued Dec. 6, 1983 shows an example of such obstructing mechanisms in the form of a pair of movable feeder blades 32,33 which stand between the operator and the conveyor input.

There also remains a need for a simple, reliable means for smoothing wrinkles from the article after it has been placed on the conveyor. Here again, it is desirable that manual smoothing operations be totally eliminated, while at the same time providing for a high volume of feed through the conveyor system.

SUMMARY OF THE INVENTION

The invention provides a positive highspeed transfer of the leading edge portion of an article from its loading position and onto the conveyor system and leaves the loading position free of obstructions and ready to receive the next article. According to a feature of the invention, there is provided a laundry feeding machine comprising a conveyor on which laundry articles are laid; a loading station at the front of the conveyor; means at the loading station for holding the article in a draped depending condition; an air tunnel arrangement enclosing at least the front part of the conveyor, the air tunnel arrangement being open at the front; a suction device for drawing air into the tunnel; and valve means for controlling the air flow in conjunction with release of the article by the holding means, thereby allowing the leading edge (upper) portion of the article, e.g., sheet material, to be sucked inwardly and onto the conveyor.

The holding means may be mechanical, but according to a specific feature of the invention comprises a grill against which the article is held by suction. Conveniently, the valve means is effective simultaneously to cut off the suction from the grill and apply it to the tunnel so that when suction through the grill is cut off to drop the article, such is applied to the tunnel to draw the article in. The suction grill proves to be much faster than mechanical clamps, particularly as applied to small articles, since the article may be immediately emplaced against the grill in a stretched condition by the operator by the simple expedient of stretching it between two opposing upper corners. The article when held by the suction grill is thus already in a smoothed condition, ready for dropping out of the conveyor.

Preferably a movable air seal device is provided at the rear of the tunnel to cooperate with the conveyor to restrict the entry of air and yet allow the exit of laundry articles. The air seal device may be a roller which rests on the conveyor to form a rolling seal therewith. Alternatively, according to a further specific feature of the invention, the seal device may be a hinged plate movable from a raised position where it is clear of the conveyor to a sealing position where it contacts the conveyor. The plate may be movable by means of an air ram. Alternatively, the plate may be spring-loaded to the raised position to be drawn down to the sealing position by suction when suction is applied to the tunnel.

According to a further specific feature of the invention, the suction device may comprise a suction fan coupled to a suction chamber above the conveyor, the suction chamber constituting the roof of the tunnel. Alternatively, the suction device may comprise a suction fan coupled to a suction chamber beneath the conveyor, the conveyor being such as to allow the passage of air and the suction chamber constituting the floor of the tunnel.

According to a feature of the invention, a spreader device is provided to spread the laundry articles sideways as they are drawn by the conveyor. This may be constituted by an appropriately shaped edge of a spreading plate which engages the article as it passes along the conveyor. Suction from the suction device may be employed to draw the trailing part of the laundry article against the spreading edge of the spreading plate. By thus streaming the article past and partially around the spreading plate, preferably configured as a portion of a circular arc, a very rapid and reliable smoothing action is achieved.

The present invention lends itself to use in multi-lane feeding, particularly where the lane configuration is adjustable. Thus, according to a specific feature of the invention, the machine may be divisible into a plurality of independent parallel feeding lanes, there being longitudinal shuttle means which can be situated to divide the tunnel into parallel sub-tunnels and valve arrangements which allow independent suction cycles to be applied to the different sub-tunnels.

Other features and advantages of the invention will become apparent upon making reference to the specification, claims, and drawings to follow.

DESCRIPTION OF THE INVENTION

Figure 1:
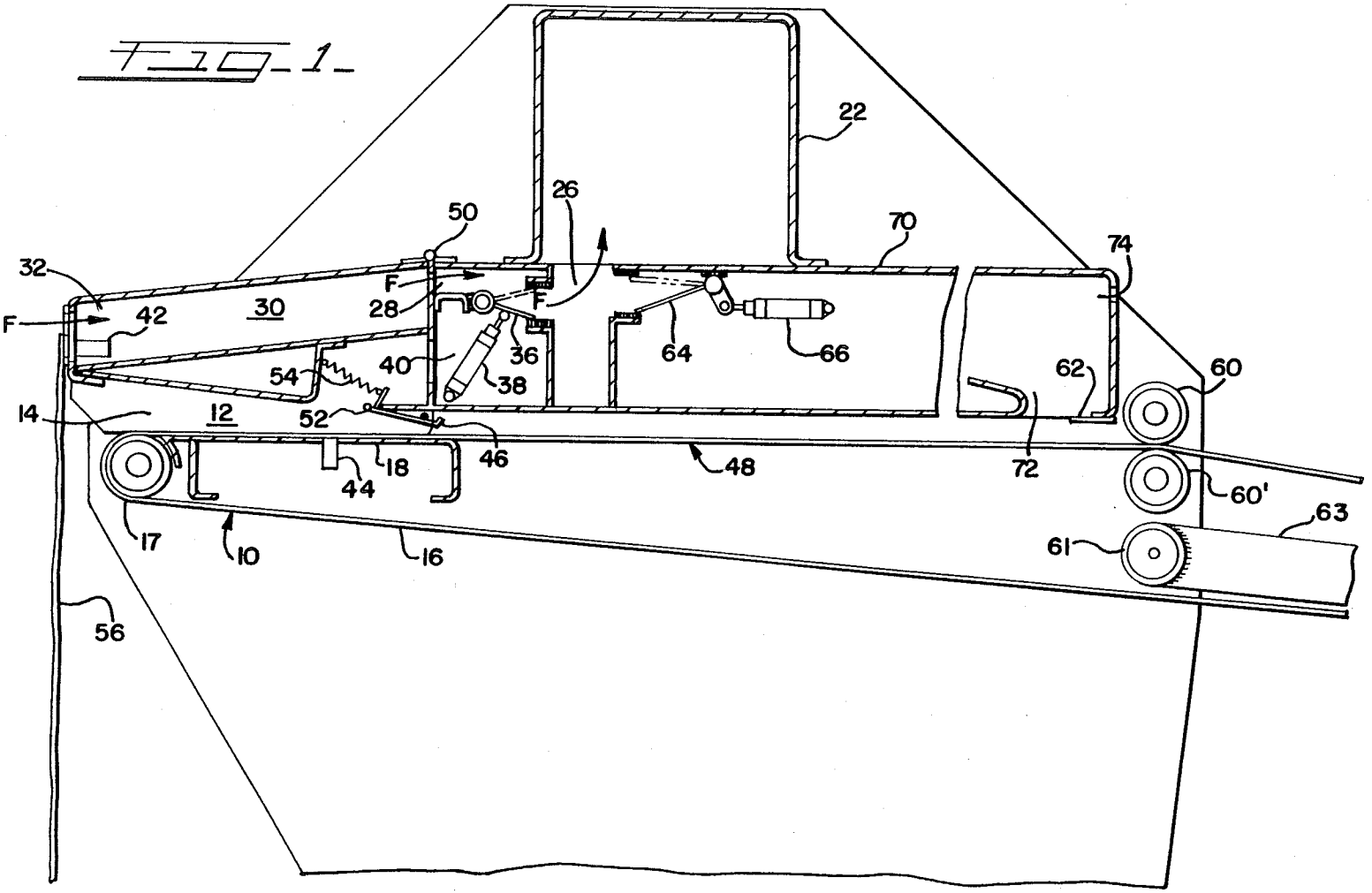
FIG. 1 is a cutaway side view of one version of the invention adapted to feeding small articles, and further showing an empty machine with a first article emplaced thereon and held in place by vacuum.
Figure 2:
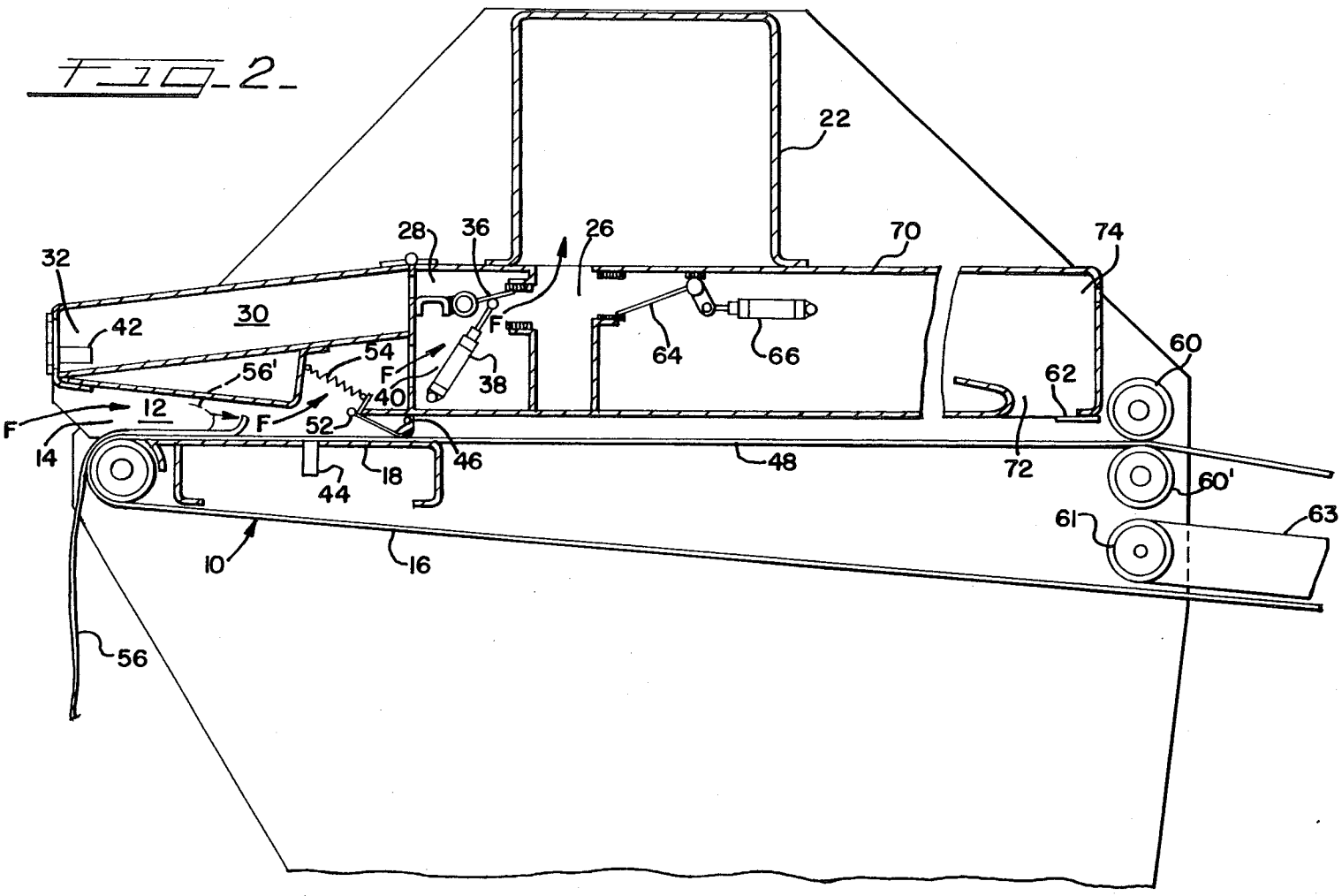
FIG. 2 shows the machine of FIG. 1 during initial phase of feeding of the article, wherein the article has been sucked onto a conveyor system.

Referring to FIGS. 1–5, the machine comprises a conveyor system 10 which is arranged to pass through a tunnel-like compartment 12 which has an open entrance 14 at the input end (front of the conveyor). The conveyor comprises spaced belts 16-16 which comprise aperture means for the passage of air therethrough (see FIG. 6) which are arranged to pass around a front roller 17, then over a deck table 18 which forms the floor of the tunnel, thence between a pair of nip rollers 60-60' to a delivery roller 65 at a receiving station (not shown), and to return therefrom. The delivery roller 65 is supported on a pair of arms 63 pivotally mounted on bearings 61 to allow height adjustment at the delivery end. This compartment 12 has a controllable and directionable air flow ducting system which incorporates a pair of suction fans. In this example a pair of centrifugal fans 20-20 in fan housings 24-24 (FIG. 6) service a lateral suction chamber 22.

Figure 6:
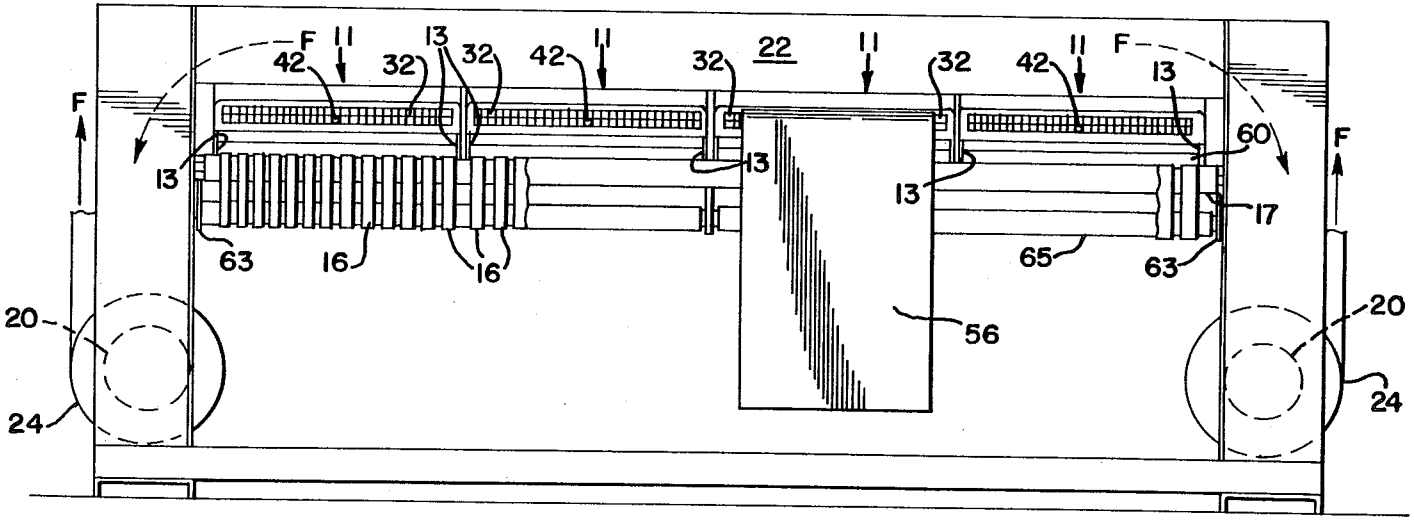
FIG. 6 is a partially cutaway front elevational view of the machine of FIG. 1 showing multiple loading stations, and further showing the position of the suction fans.

When an article is positioned across the input entrance of the tunnel and air ducts are momentarily operated, the leading edge portion of the article is rapidly drawn into the tunnel and positively placed onto the moving conveyor. The next article can then be positioned for feeding. With particular reference to FIG. 6, an array of four parallel loading stations 11-11 are shown, each station separated by partition plates 13-13, defining four parallel independent feed paths. The following discussion is a description of the operation of a single feed path. As will subsequently be shown with respect to an alternative embodiment of the invention, these dividing plates 13-13 may be selectively removed, most preferably simply by lowering them, so as to provide for a wider feeding path if desired.

In more detail, the fans 20-20 establish a partial vacuum in the suction chamber 22. Chamber 22 communicates via ports 26,28 with a suction box 30. At the front, the suction box 30 has a vertically oriented grill aperture 32, and laundry articles to be fed are temporarily held by their top edges at the loading position by suction against the grill. This feature is similarly disclosed in FIGS. 1 and 2 of the parent application.

An induction valve 36 is operated by an air ram 38. When induction valve 36 is in the lower positioned, suction is applied to the suction chamber 30 via port 28 and is cut off from tunnel 12. In this condition the upper edge of a laundry article is held draped at the front of the machine with an upper portion hanging down before the open entrance 14 to the tunnel 12. When the air ram 38 is momentarily operated to change over the valve 36, suction to the suction chamber 30 is cut off and applied to the tunnel 12 via port 40. Thus, simultaneously the article is dropped from the grill passage 32 and sucked into the tunnel 12 to be laid on the moving conveyor 10. The valve 36 then immediately reverts to reestablish suction at the grill passage 32. A similar feature is disclosed with reference to FIG. 4 of the parent application.

Photosensors 42,44 are effective to sense the presence of a laundry article and control the system accordingly, as will be discussed in detail subsequently. The articles on the conveyor pass under a sealing plate 46 and onto the delivery end 48 of the conveyor, typically for delivery to an ironing machine. The upper part of the assembly, including the suction chamber 30 and tunnel upper walls 13-13, are pivotally mounted on the machine at 50, so as to be capable of being swung up to give direct access to the conveyor if required.

The sealing plate 46 is hinged at 52 and is spring-loaded by a spring 54 to an upper position where it is clear of the conveyor 10. However, when suction is applied to the tunnel 12, the plate 46 is drawn down thereby to make contact with the conveyor and thereby reduce air intake from the exit of the tunnel. A similar sealing system is discussed in the parent application with particular reference to FIG. 4 therein. When suction is removed from the tunnel, the spring 54 draws the plate back to its upper position. Alternatively, an air ram may be employed.

Referring next in-particular to FIGS. 2–5, FIG. 2 shows an article 56 shortly after the induction valve 36 has been operated to transfer vacuum from the suction chamber 30 to the tunnel 12. As will be discussed subsequently, this is a momentary actuation, and vacuum is held applied to the tunnel 12 only long enough to transfer the leading edge of the article 56 to the table 18. It will further be noted that the position of the table photcell 44 is sufficiently advanced along the path of travel that the leading edge of the article 56 does not immediately confront this element. It will also be noted that during this induction phase the sealer plate 46 is momentarily drawn down by the tunnel vacuum to improve the suction properties of the input port 14. This situation lasts only so long as the induction valve 36 is supporting suction from the chamber 22 to the tunnel 12.

Figure 3:
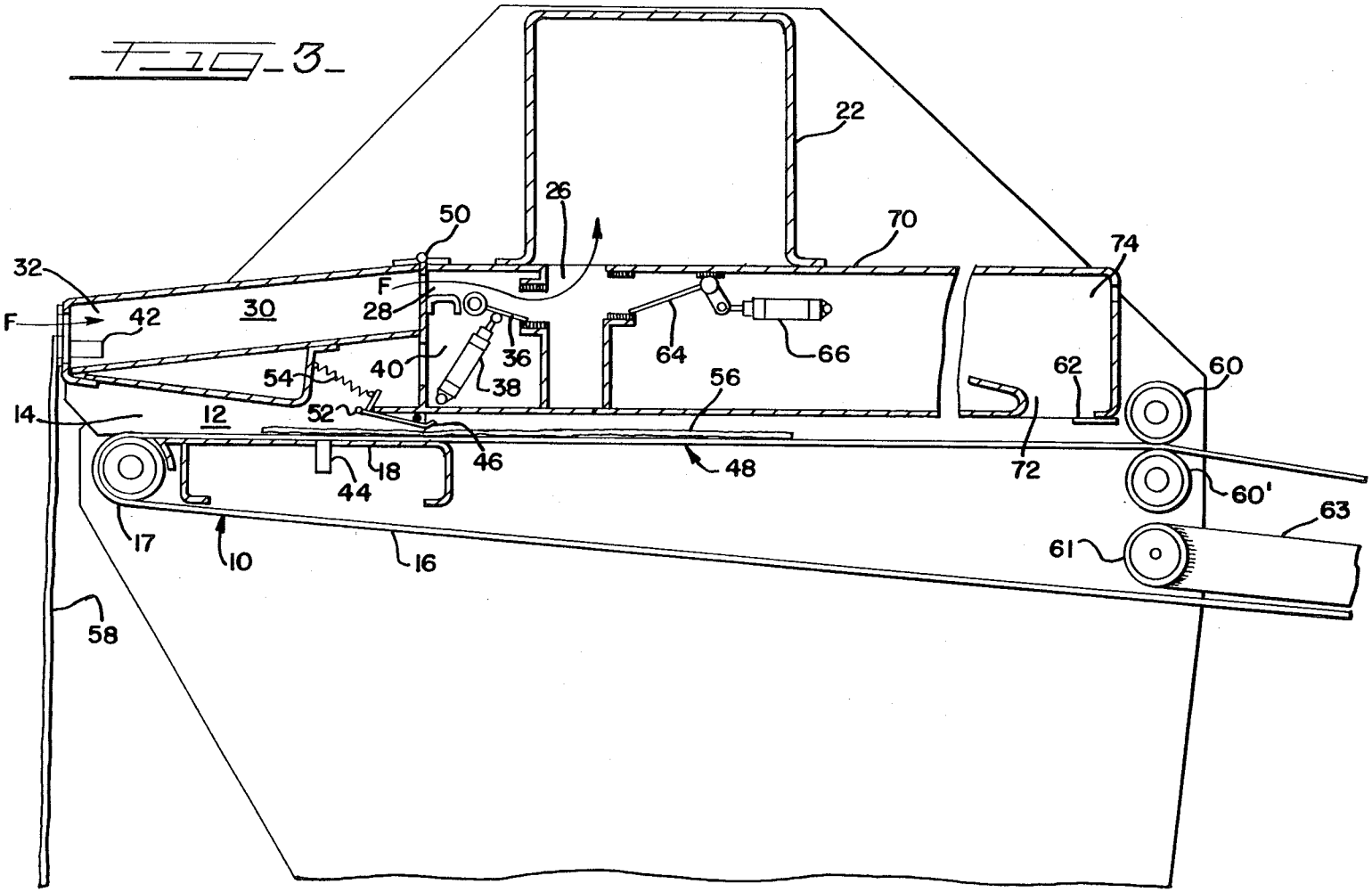
FIG. 3 shows the machine of FIG. 1 at a later phase of the transport of the first article through the machine, and further showing a second article in place for subsequent feeding.

FIG. 3 shows a later phase in the operation wherein the original article 56 has been transported to the point where its trailing edge is almost opposite the table photocell 44. Valve 36 has reverted to reestablish vacuum in suction chamber 30, and a second article 58 is shown emplaced thereon.

Figure 4:
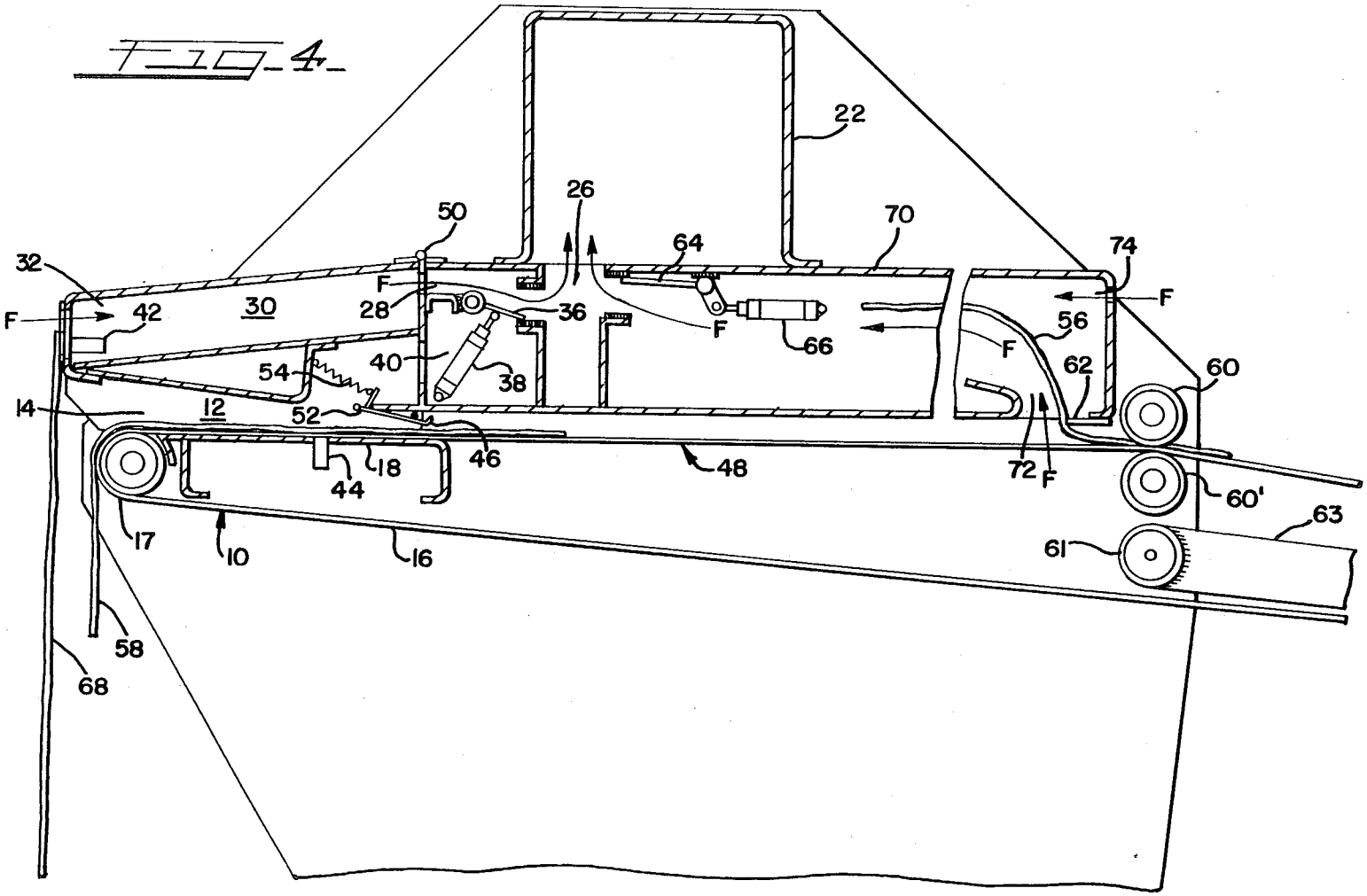
FIG. 4 shows the machine of FIG. 1 at a later phase of operation, showing the first article undergoing a spreading and smoothing operation by means of a suctioninduced air blast, and a second article inserted into the machine.
Figure 7:
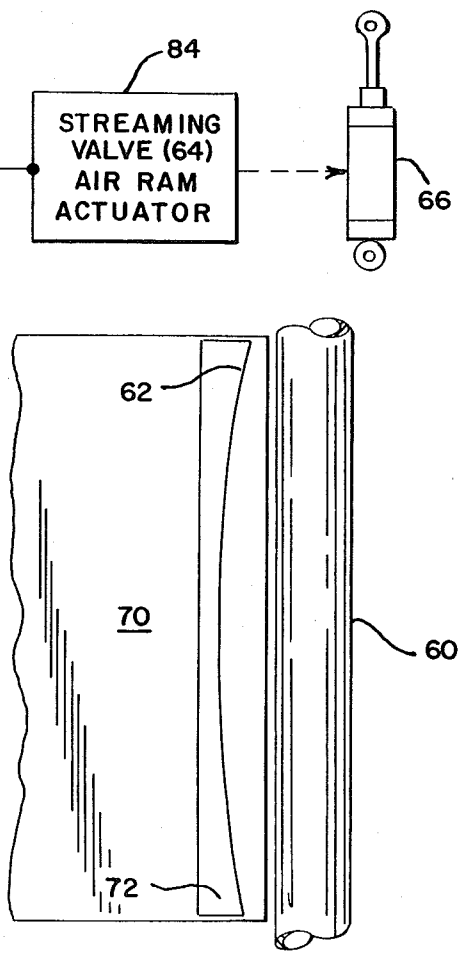
FIG 7 is a partial bottom view of the machine of FIG. 1 in the vicinity of an output nip roller.

FIG. 4 shows a still later phase of operation, wherein a third article 68 is held in place before the grill 32, the leading edge of the second article 58 has passed the table photocell 44, and the first article 56 has been engaged by the nip roller at the leading edge thereof. A second suction chamber 70, selectively communicating with the suction chamber 22 through a streaming valve 64 operated by an actuator element 66 can be opened on command to establish a major air flow through a port 72 at the base of the suction cham-ber 70 in the vicinity of the nip roller 60. The result of opening the streaming valve 64 is to cause an immediate inrush of air through port 72, thereby lifting the trailing portion of the first article 56 from the conveyor belt and into the suction chamber 70, the article being further deflected to the left by an auxiliary leftward flow of air admitted through a small venting port 74 in the upper rightmost surface of the suction chamber 70. It will thus be seen that the article is streamed up into the suction chamber 70 and generally to the left as shown. Along the rightmost edge of the port 72 is a spreader blade 62 (see FIG. 7), the blade having a circular arc type curvature such that central portions thereof extend farther to the left as seen in FIG. 7 than do the edges thereof. This has the general effect of smoothing the article 56 so that it passes under the nip roller 60 in an unwrinkled condition. Alternatively, the leading edge of the blade 62 may be angled obliquely downward to the left and the chamber 70 may be reconfigured so that the streaming action forces the article to make a very sharp bend around the blade 62 as it enters the chamber. Such an embodiment is shown in FIG. 7 of the parent application. By physically streaming the entire unsmoothed portion of the article around the blade 62, a more rapid and efficient smoothing action may be secured as contrasted to the ribbed suction box described in U.S. Pat. No. 3,436,853 issued Apr. 8, 1969.

Figure 5:
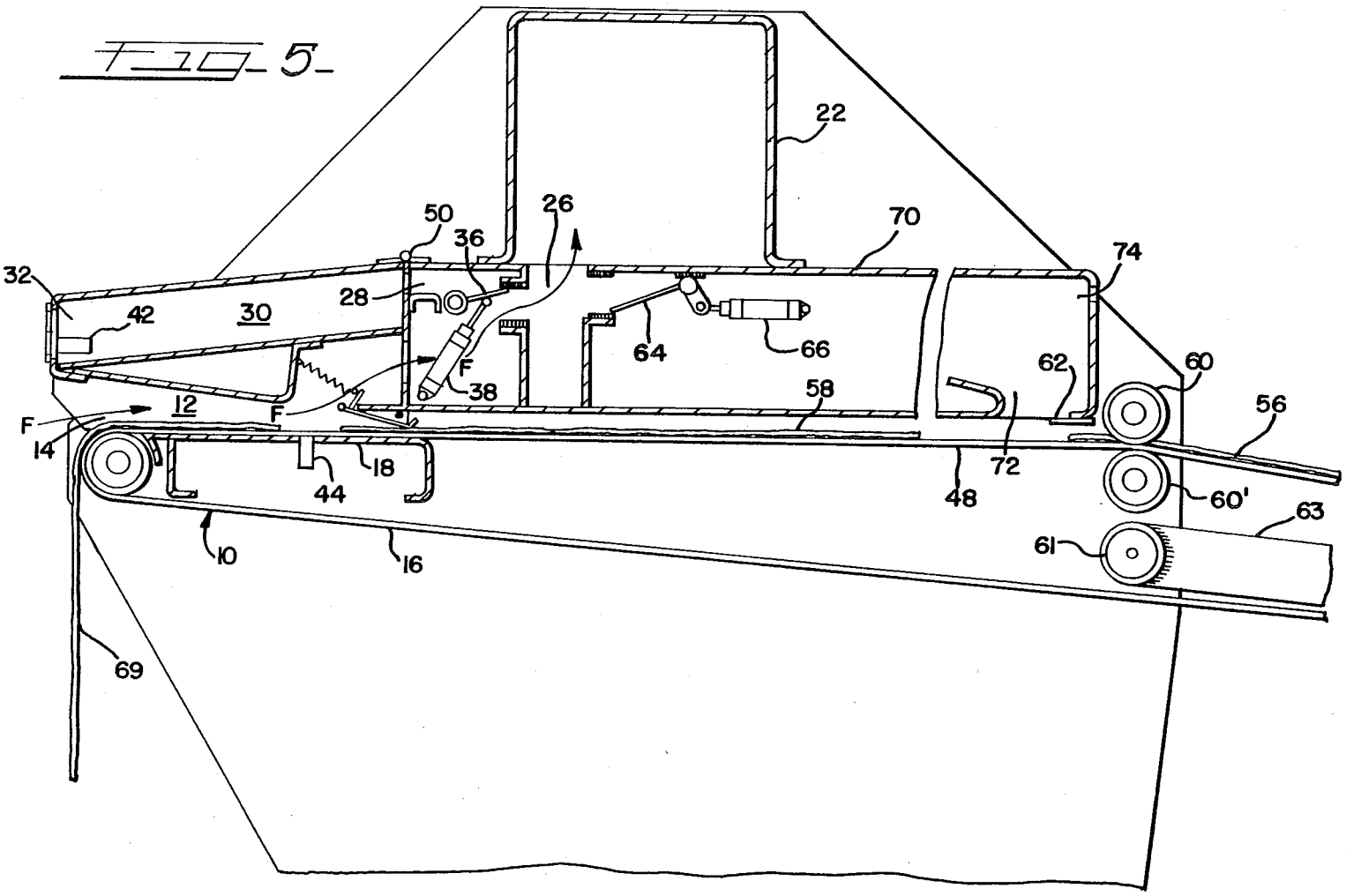
FIG. 5 shows the machine of FIG. 1 wherein the first article is exiting the machine, the second article is halfway in transport therethrough, and a third article has just been sucked into the machine.

FIG. 5 shows the final stage of processing of the article 56, wherein the trailing edge thereof is about to pass beyond the nip roller 60. As will be subsequently discussed, at this time the streaming valve 64 is automatically reverted to a closed condition so as not to pick up the second article 58 when the leading edge thereof comes into proximity with the streaming port 72. It will also be noted that at this time the third article 68 has just undergone the induction phase of loading into the tunnel 12.

Figure 8:
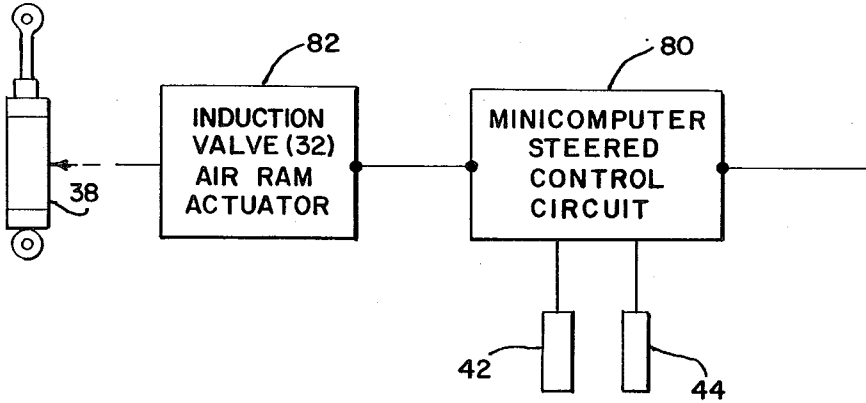
FIG. 8 is a schematic representation of the control circuitry of the present invention, employing a minicomputersteered control circuit.

To govern the timing of the induction and streaming valves 36,64, the preferred form of the invention utilizes a minicomputer 80 (FIG. 8) for carrying out internally governed timing operations responsively to article emplacement before the grill photosensor 42 and to article passage past the table sensor 44. At appropriate times the induction valve air ram 38 is operated by an induction valve actuator 82, most typically actuated in turn by an electrically operated pneumatic valve so as to cause extension or retraction of the air ram 38. A similar operation using a streaming valve air ram actuator 84 controls the streaming valve air ram 66 to either of the two chosen positions.

The basic concept of the timing system which governs the actuation of the air rams 38,66 is based, in the simplest case, on the fact that the conveyor 10 operates at a known speed, a value which may easily be entered into the memory of the minicomputer 80 as a known value.

Again referring to FIGS. 1-5, the grill photosensor (photosensing cell) 42 and the table sensor 44 are sensed at appropriate intervals to insure that the loading table 18 is clear before the next article is sucked into the loading table, and to provide a slight delay in any case from the time an article is emplaced over the grill 32 before the loading (induction) phase begins, so as to give the operator sufficient time to stretch the article flat against the grill. Also, the table photosensor 42 sensings are used to establish the time of passage of the leading edge of an article on the loading table 18 past the table photosensor so as to initiate a timing operation based upon conveyor speed to predict the arrival of this leading edge at the nip roller 60. At this time the streaming valve 64 is automatically operated. From the time of passage of the trailing edge of the article past the table sensor 44 a similar computation is used to govern the duration of actuation of the streaming valve 64 so as to terminate the streaming operation as soon as the trailing edge of the article has passed to the nip roller 60.

Since the various versions of laundry feeders described herein are designed to pass articles to a subsequent processing station, e.g., an ironing machine, it is desirable that the speed of the conveyor system, as governed by the motor drive system thereof (not shown), as well as the timing of the valve actuations, be appropriately synchronized with respect to each other, and also with respect to the take-up rate of the ironing machine. Moreover, for different sizes of articles, ironing machines may be optionally driven at different rates. To accommodate such variations, as will be evident to those of ordinary skill in the art by a straightforward extension of the principles set forth herein, it is possible to govern the speed and sequencing of operations in the laundry feeder by governing its operations according to the chosen speed of the ironing machine. Such operations may most readily be governed by a tachometer pulse generator slaved to the speed of the ironing machine to generate a timing pulse train, which in turn may be used to govern the speed of delivery of the feeder, and similarly the timing of the valve sequencing therein. For purposes of the discussion to follow, it will be presumed that, irrespective of how the speed of the conveyor system is established, it is characterized by a known (or inferrable) value.

Figure 9:
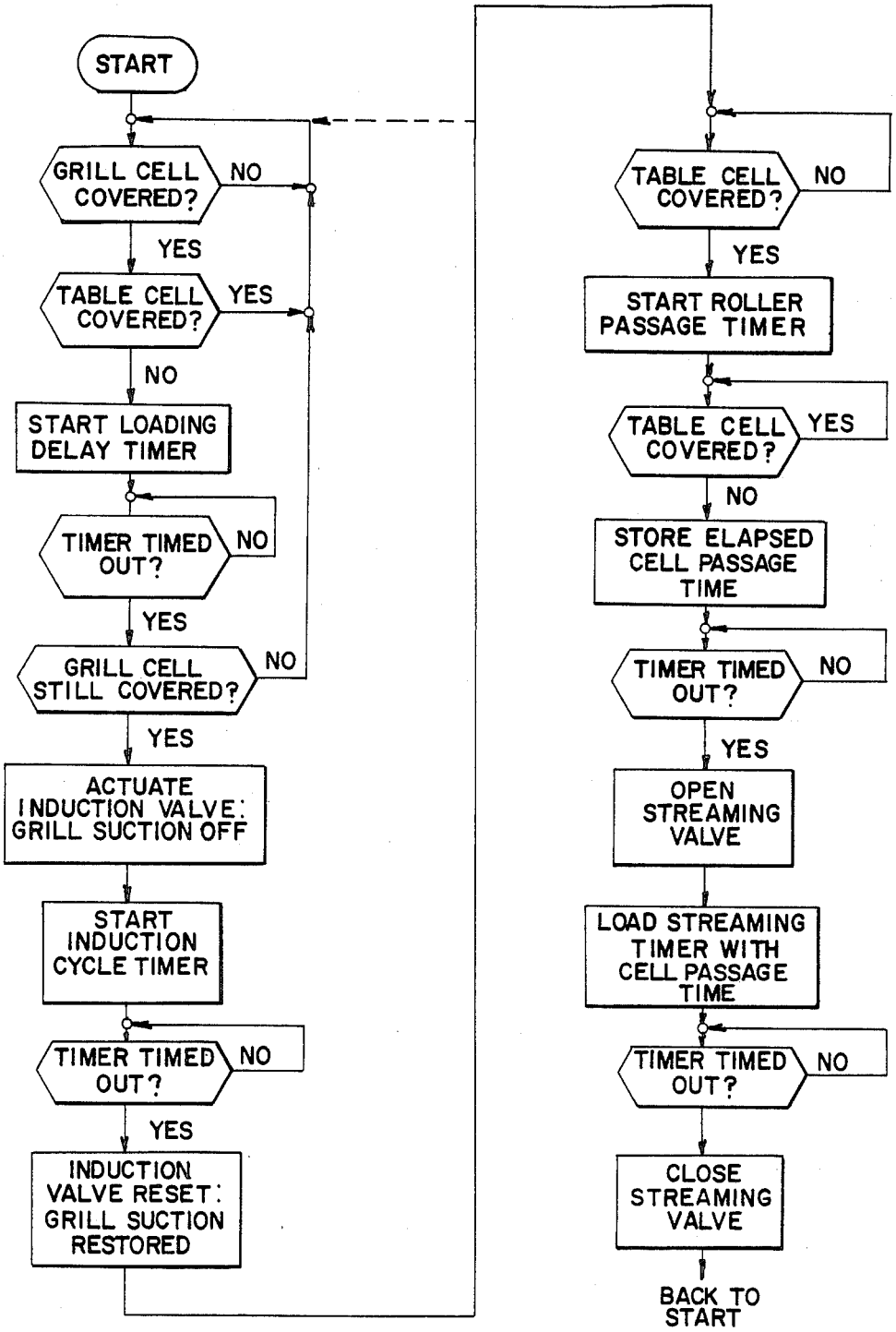
FIG. 9 is a program flow chart governing the operations of the minicomputer of FIG. 8 to control the sequencing of the embodiment of the invention shown in FIGS. 1–7.

One representative way of timing these operations is shown in the flow chart shown in FIG. 9. The timing operations indicated therein are most easily performed by means of programmed timing loops written into the computer software, a technique immediately recognizable by those skilled in the art. By such techniques, either a predetermined time is allowed to elapse after which some form of warning signal condition or device actuation occurs, or alternatively such timing loops can be used to measure and store the elapsed time between two events, such as changes in photosensor sensings. Thus, with reference to FIG. 9, showing one possible program flow chart governing the actions of a minicomputer, in Steps 1 and 2 the photosensor 42 confronting the grill passage 32 (grill cell) and the photosensing cell 44 facing upward to detect the presence of a confronting laundry article (hereinafter referred to as the table cell) are repeatedly sensed until it is established that the table cell is uncovered, indicating a clear leading portion of the tunnel 12, and that a laundry article is emplaced in front of the grill cell.

As soon as this condition is established, a delay cycle (Steps 3 and 4) is initiated to give the operator time to adequately spread the article in proper position on the grill, whereupon a final grill sensing indicating that the grill cell is still confronting an article (Step 5) causes immediate actuation of the induction valve actuator 38 to transfer suction from the grill suction chamber 30 to the tunnel 12 (Step 6). It will be recalled that this merely a momentary operation, and to establish the duration of this cycle, an induction cycle timer, most typically a timing loop in the computer program, is started so as to run for a preset time (Steps 7 and 8). At the end of this time the actuator 38 reverts to its original position, reestablishing the original valving configuration so as to seal the tunnel 12 from the suction system, and to reestablish vacuum in the grill suction chamber 30. This corresponds to Step 9.

A continuous sensing of the table photosensing cell 44 is then carried out until the passage of the leading edge of the article is detected. At this time a new timing operation starts (Step 11), which will establish the time at which this same leading edge of the article will be engaged by the nip roller 60, so as to then be securely fastened for the streaming and smoothing operation. Interrogation of the table photosensing cell continues until the trailing edge of the article has moved away from the table cell, at which point the elapsed time is stored in computer memory; however, the timing operation continues. By this means, not only is the arrival time of arrival of the leading edge of the article at the nip roller 60 being properly timed, but the time of clearing of the trailing edge thereafter may also be obtained. Step 14 tests for the end of the roller passage timing operation, indicating that the leading edge of the article has arrived at the nip roller 60 (Step 14). At this point the leading edge of the article is properly secured, and the streaming valve 64 is actuated to an open position to draw the article into the suction chamber 70 to be spread by the smoothing blade 62.

At this point a new timing operation is initiated, using the elapsed time of passage of the article past the table cell (Step 13 above), this timing operation holding the streaming valve 64 in the open position until this timing operation has terminated, whereupon the trailing edge of the article has disengaged from the smoothing blade 62, and the streaming valve 64 is returned to a closed condition (Step 18). The cycle then repeats.

The foregoing is merely one representative way of controlling the various timing sequences of the system, and other variants will readily be apparent to those skilled in the art. For example, alternatively an additional photosensor could be placed in the general vicinity of the nip roller 60 to govern the operation of the streaming valve 64. A great many other such variants may be employed without departing from the scope of the invention.

In particular, it will be noted that the representative program sequencing described hereinabove may readily be modified to provide for sequential sensings of multiple articles in transit, using sensings of passage of the leading and trailing edges of each article in sequence to control simultaneously operating timing systems, each one predicting and storing in memory the engagement time of its associated article with the nip roller and the disengagement time thereof with respect to the smoothing blade. Methods for accomplishing this will be readily evident to those knowledgeable in the art. For example, this may take the form of coprocessing systems, or alternatively multiple electronic timers serviced by computer parts to be rapidly interrogated and recycled so that each timer is temporarily assigned to a given article to govern the valving oeprations pertaining thereto.

A dashed line is shown in FIG. 9 returning the system to START immediately after each induction operation. This option, i.e., removing streaming valve control from the program, is applicable to feeders not having such a system, in particular to the systems shown in FIGS. 10–13, which will be discussed next.

Figure 10:
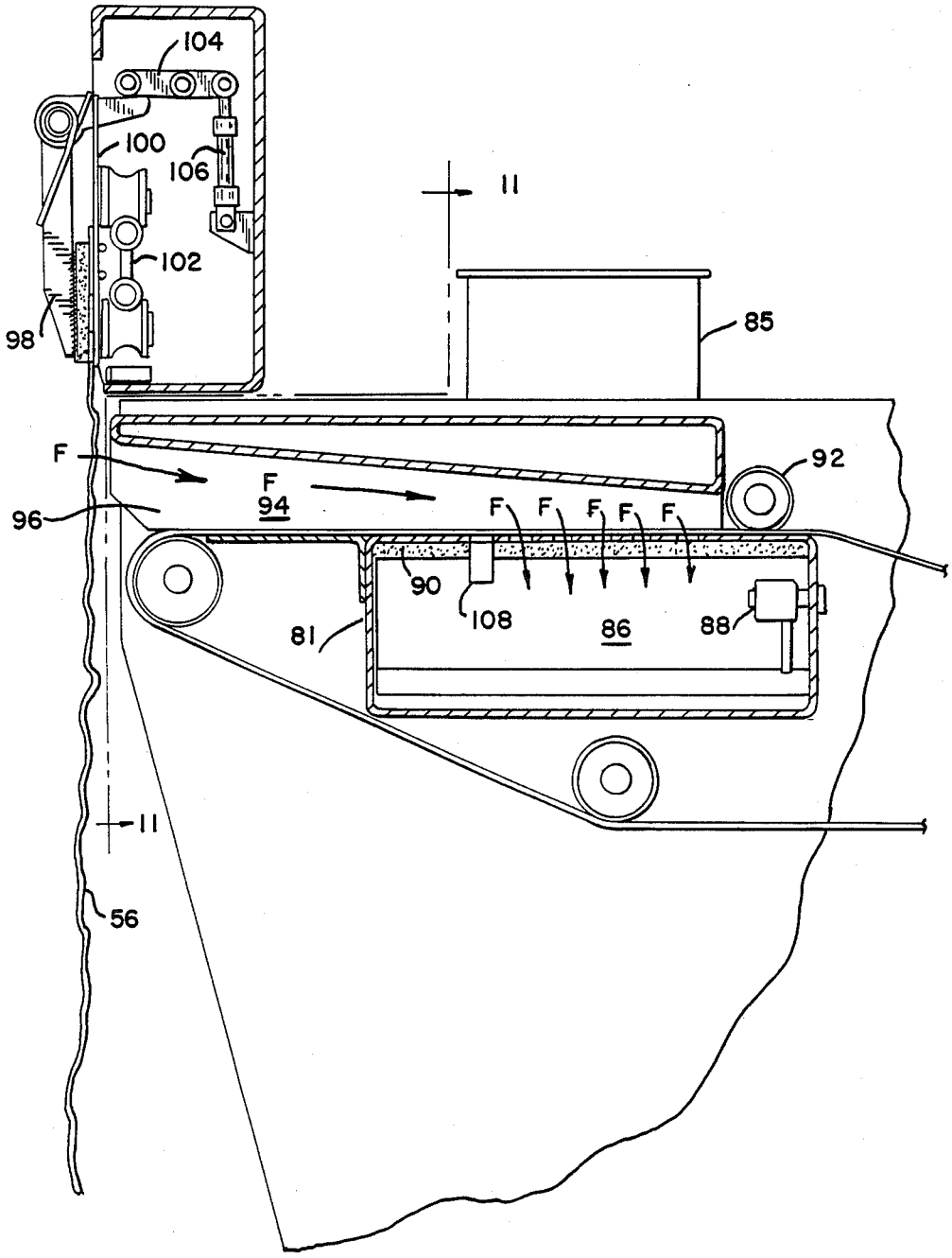
FIG. 10 is a partial cutaway side view of the loading region of a second embodiment of the invention adapted for feeding large articles.
Figure 11:
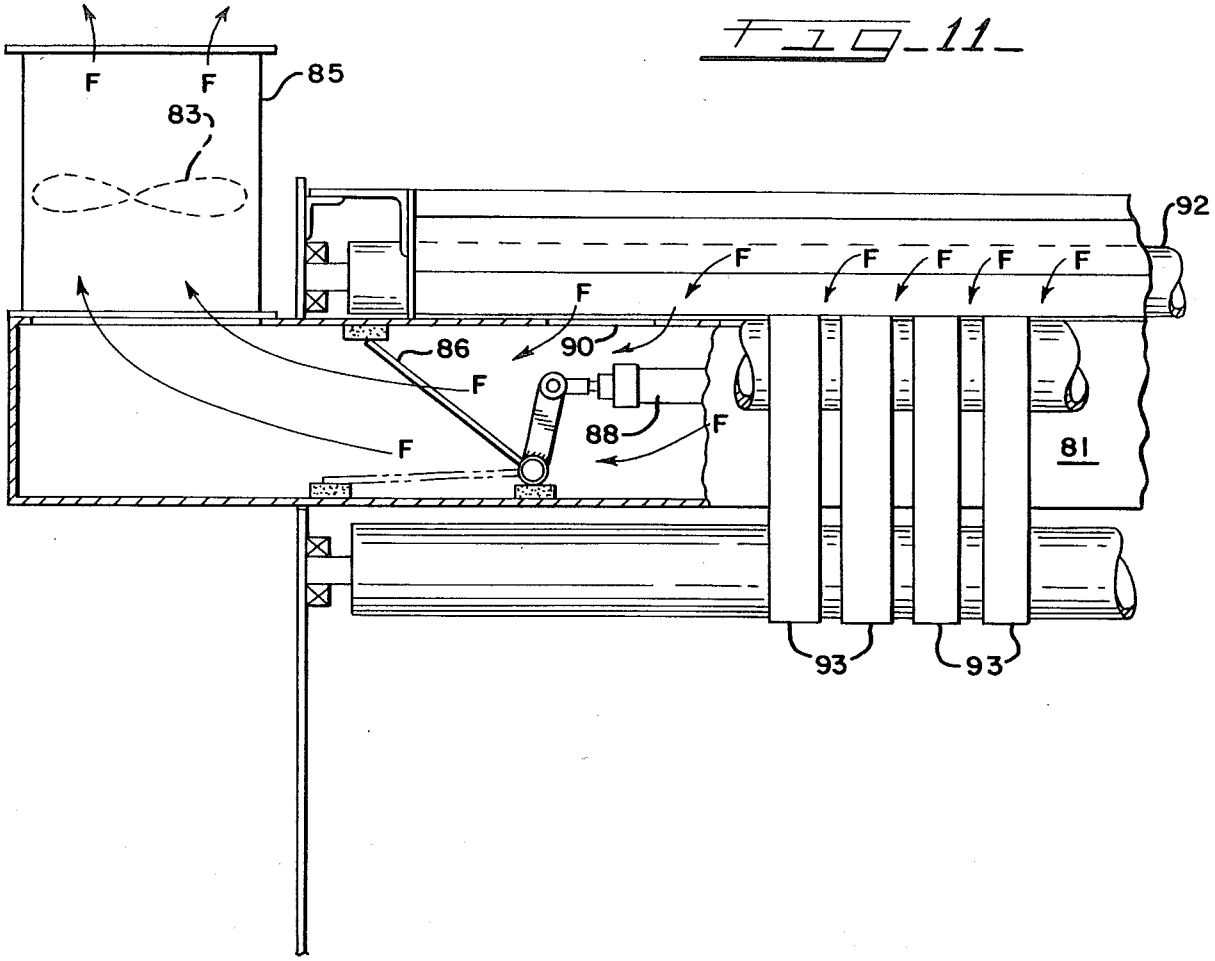
FIG. 11 is a partial cutaway front elevation of a portion of the loading station of the machine of FIG. 10

FIGS. 10 and 11 show an alternative embodiment of the invention particularly adapted to the handling of very wide articles, such as bed sheets. Here a transverse suction chamber 81 is evacuated by a blower 83 at either end, each blower residing in a housing 85. Only one half of the system is shown in FIG. 11. The suction applied to the central portion of the suction chamber 81 is governed by a pair of symetrically disposed valves operated by associated air rams 88. In this version of the invention, the conveyor belts 93-93 pass immediately over the top of the suction chamber 81. The top wall 90 of the suction chamber 81 is of perforated or otherwise open construction allowing air passage thereinto. Incoming air is sucked through a series of slits formed by the interval spacings of the conveyor belts 93-93. Alternatively, perforated belts can be employed which permit the free passage of air through the mesh construction.

The nip roller 92 is positioned close to the end of the tunnel 94 to provide an adequate air seal to insure that the flow of air from the tunnel inlet 96 is confined to flow into the suction chamber 81. The holding station for the article is a pair of clamps 98 (one shown) fixed to their respective carriages 100, which are movable along a track 102. The corners of the article are placed in the clamps 98 which move along the track 102 and spread the article in front of the tunnel inlet 96. This is a known and conventional procedure for handling and spreading large pieces of laundry in feeding machines, two of which are described in U.S. Pat. No. 4,411,083 issued Oct. 25, 1983, and Reissue Pat. No. 31,453 issued Dec. 6, 1983. This method of holding may advantageously replace the suction grill system previously described for use with small pieces. When the article has been suitably spread and suspended, valve 86 is opened by an actuating cylinder (air ram) 88, causing high volume air to be drawn into the tunnel 94. Simultaneously, the clamps 98 are opened by lever mechanisms 104,106. This releases the article, which then is drawn into the tunnel 94 and fed onto the conveyor system. The spreading and smoothing of the trailing portion of the article may be performed by a variety of known and proven methods, such as outward running belts as shown in U.S. Pat. No.

4,050,173 issued Sept. 27, 1977. In addition, the emplacement of the suction box 81 below the conveyor can also assist in the spreading and smoothing operation, as detailed in U.S. Pat. Nos. 4,050,173 issued Sept. 27, 1977, 3,436,853 issued Apr. 8, 1969, 3,483,645 issued Dec. 16, 1969, and 3,909,694 issued Oct. 7, 1975. In the version shown in FIG. 10 of the present application, a single photosensor 108 is emplaced viewing upward from the suction box to detect the leading and trailing edges of an inserted article to govern a simplified computer control of system by sequencing.

Figure 12:
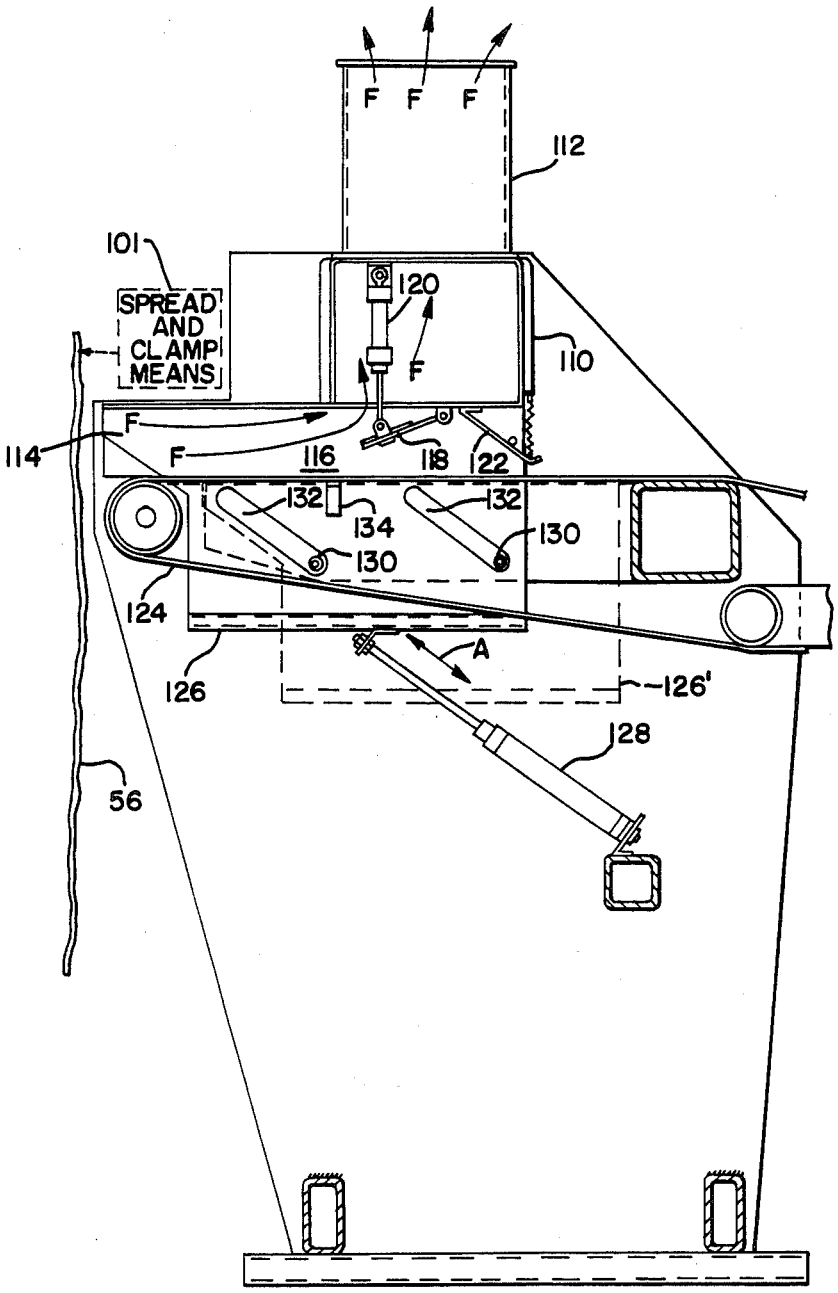
FIG. 12 is a cutaway side view of a third verion of the invention showing a movable tunnel divider plate.
Figure 13:
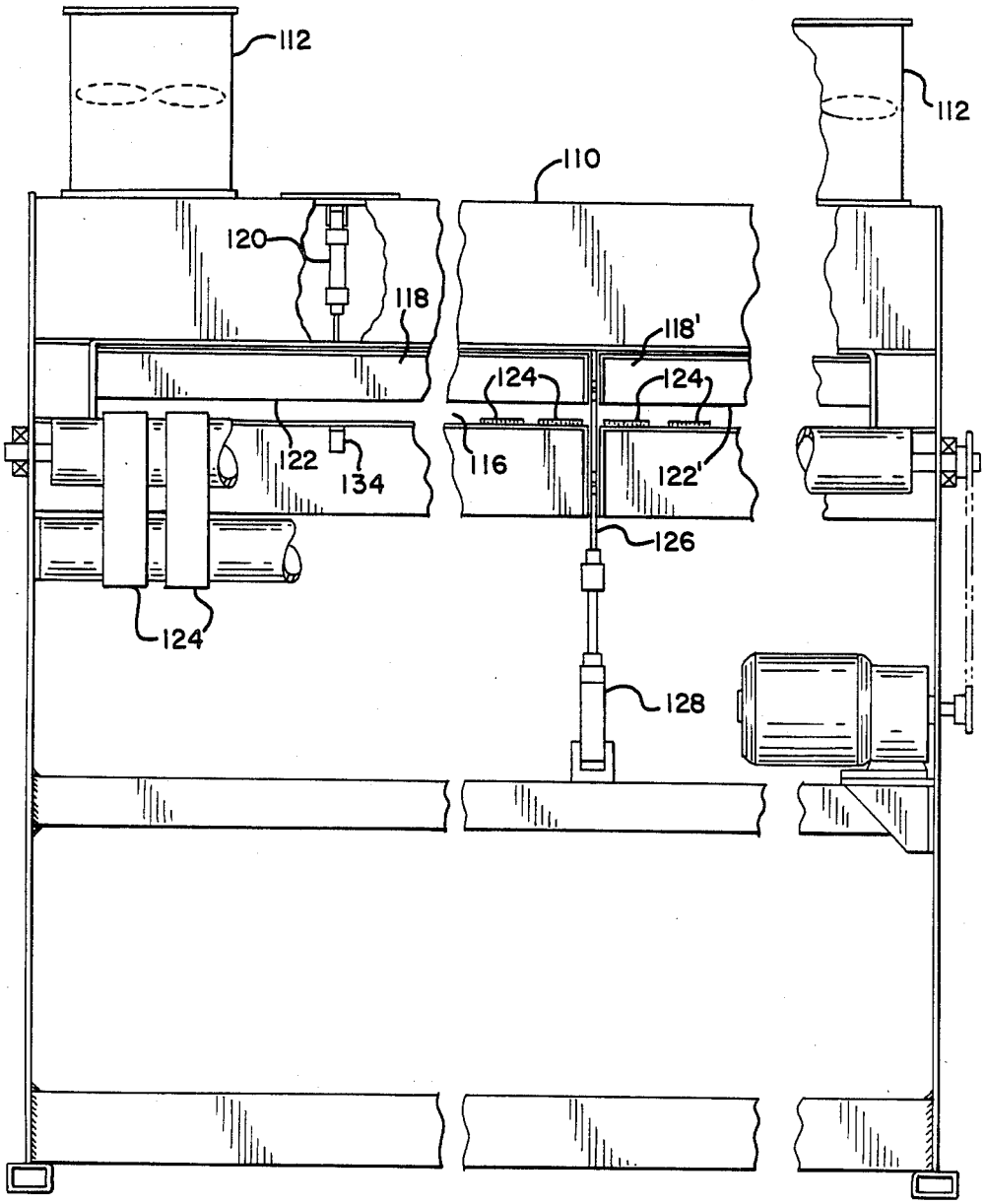
FIG. 13 is a partially cutaway front elevation of the machine shown in FIG. 12, showing the divider plate in a raised position to provide a pair of parallel processing passages.

FIGS. 12 and 13 show a slightly different version of a large article-handling machine. A suitable self-centering spreading system 101 such as described in U.S. Reissue Pat. No. 31,453 issued Dec. 6, 1983 may be employed, suitably modified to relocate its centerline for reasons which will shortly become evident. A similar transverse suction chamber 110, here mounted above the tunnel 116, and similarly serviced by a pair of blowers in housings 112 pulls an air flow through the tunnel inlet 116 responsively to actuation of a valve 118 by an actuator 120. A spring-loaded sealing plate 122 is used to secure rear vacuum seal for the system as before. This particular version of the system, however, has in addition a partition plate 126 having a pair of parallel slots 132 therein, pins 130 guiding the plate for general up-and-down and simultaneous front-to-rear reciprocating motion responsively to operation of an actuator 128 as evidenced by arrow A and phantom plate outline 126'. A similar system is described with reference to FIG. 8 of the parent application. As will be seen in FIG. 13, the plate 126 is disposed to pass between a given pair of adjacent conveyor belts 124-124.

By this means there is provided a conveyor system which can be reconfigured at will to a multi-path system wherein two (or more) parallel processing paths are provided. In the version shown, having only two such paths, there are two valves 118,118' to be separated at will by the partition 126. Valve 118' has a similarly dedicated actuator (not shown) for independent operation thereof. Similarly, a second photosensor (not shown) is also provided to govern the sequencing of valve 118'. A plurality of such divider plates 126 may be provided, the valve plates 118,118', etc. being appropriately divided and each having its individually dedicated actuator, e.g., 120. Further, each such optional passageway is also provided with its own photosensing system, e.g. photosensing cell 134, and its counterparts. A minicomputer programmed similarly to that previously outlined may readily be devised for simultaneously sensing all system photosensing cells, and for actuating the appropriate valves at the appropriate times.

One approach would be to dedicate an individual minicomputer to each path so as to sense the photosensors governing that path and the valving actuators servicing that path. In the event that, for example, one divider forming two separate adjacent paths is lowered to provide one large passage, then the minicomputer servicing either passage may be employed to govern the valving of both passages by the simple expedient of using a simple throwover switch, so that the electrical solenoids which actuate the air pistons (air rams) of the two adjacent paths are simply connected in parallel. The system will then take its passage sensings from one set of path photosensors, and the valving systems of the adjacent path will be governed by the same minicomputer command signals that govern the valving of this path.

Figure 14:
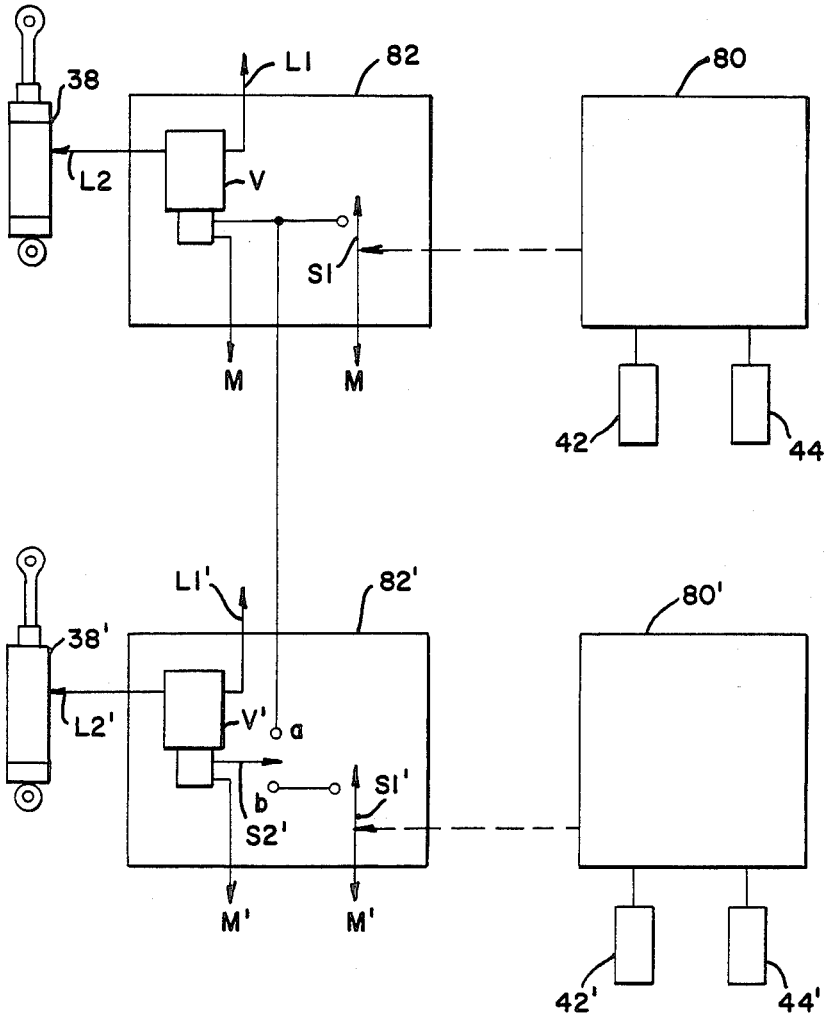
FIG. 14 is a schematic representation of control circuitry used to control alternatively the induction cycles of two parallel feed passages or one combined feed passage by means of a throwover switch.

FIG. 14 shows in schematic form how this may be accomplished with respect to control of the sequencing of a pair of induction valve air rams 38,38'. Each of the two paths is governed normally by its associated minicomputer-steered control circuit 80,80', each normally governed by its associated photosensors 42,44 and 42',44' respectively. Each of the induction valve air ram actuators 82,82' is provided with a solenoid-operated pneumatic valve V,V' valving the control of air from high pressure source lines L1,L1' to their associated air rams 38,38' by high pressure air lines L2,L2'.

With particular reference to the upper system shown in FIG. 13, control of the valve V is effected by actuation of a switch S1 operationally controlled by signals from the control circuit 80 to apply valve actuating power from electrical mains M,M'. The air ram actuator 82' for the adjacent passage is similar to its counterpart, but is modified to insert a user-operated (or computer-steered) single-pole double-throw switch S2, connected so that with S2 contacting terminal b, air ram actuator 82' operates in a mode completely independent of its counterpart 82, and is governed solely by the sensings of its associated photosensors 42',44'. If, on the other hand, switch S2 is thrown so that it contacts terminal a, then its energization will be solely governed by switch S1 of air ram actuator system 82, and therefore air ram 38' will be actuated synchronously with air ram 38 responsively to control signal conditions produced by steering control circuit 80 alone, i.e., responsively only to sensings produced by photosensing cell 42.

Clearly, such techniques may be readily extended to govern the operation of the streaming valve air rams, and may be further extended to systems configurable to more than two passages. A great many possible variants on the foregoing will immediately be evident to those of ordinary skill in the art. Moreover, it is equally evident that the similar path-combining and path-isolating techniques may be applied to the small article system shown in FIGS. 1-7.

In the case of equipment only operable in a single-path mode as shown in FIG. 10, there could be operators at opposite sides of the equipment who alternately feed the ends of the sheets to clamping and spreading means like that shown in U.S. Reissue Pat. No. 31,453 previously referred to. Where the equipment is operable in either a single-path or double-path mode as shown in FIGS. 12 and 13, when the equipment is operable in a single-path mode, the clamping and spreading means involved must spread and center the piece involved from a point preferably at the center of the single suction tunnel defined by the equipment. The clamping and spreading means could be the same clamping and spreading means shown in U.S. Reissue Pat. No. 31,453, which is designed to move either the pair of clamping devices 8-9 at one side of the equipment or the pair of clamping devices 10-11 at the other side of the equipment together to the center point of the equipment involved, following which the pair of devices move apart to spread the piece involved.

When the equipment is operaole in its double-path mode where the suction tunnel is divided, for example, into two tunnels of half the original width, the clamping and spreading means involved must now spread the piece from a different center point, namely a center point which is halfway between the center point used during the single-path mode of operation of the equipment. In such case, the two pairs of clamping devices 8-9 and 11-13 shown in U.S. Reissue Pat. No. 31,453 readily perform this operation from these different center points by changing the length of the pushing rod 40 shown in FIG. 3 thereof. The rod 40 associated with each of the clamping devices 8-9 and 11-12 of this Reissue Patent could be an adjustable length pushing rod, such as a telescoping tube which can be set at a desired length to establish the desired point at which the clamping devices separate to spread the piece involved.

The invention is not restricted to the details fo the embodiment described with reference to the accompanying drawings. For example, other or additional spreading and smoothing arrangements may be used. One such arrangement is a suction box located across and just below the conveyor feed end roller. The trailing part of the article is drawn into and spread by the suction box spreader by the previously mentioned streaming action after the leading portion of the article has been fed onto the conveyor.

Alternatively, spreading and smoothing can be effected by an elongated straight or curved suction nozzle across the top of the conveyor, the article being drawn across the lips of the nozzle by suction as it is fed forward on the conveyor. Positive roller gripping of the leading edge of the article would be necessary to prevent the article from being arrested by the nozzle. More than one nozzle can be provided for successive stages of smoothing.

Another smoothing arrangement which may be provided consists of a suction nozzle in the mouth of which is a pair of perforated contra-rotating belts which draw the article out by friction in opposite directions from a center line.

As previously stated, the feeding machine will generally feed the articles to an ironing machine conveyor, and in order to prevent over-running, it is preferred to drive the conveyor of the feeding machine by an electric motor which is controlled in accordance with the ironing conveyor speed in response to a tachometer drive thereby. By minor variation which will be evident to those skilled in the art, continous tachometer sensings may be used to govern the minicomputer timing regime.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A laundry feeding machine comprising a conveyor on which laundry sheet material is to be fed; a loading station at the front of the conveyor; holding means at the loading station for releasably holding the leading edge portion of sheet material with the rest thereof in a draped depending condition; an air tunnel enclosing at least the front part of the conveyor, the air tunnel being open at the front at a point adjacent and below the holding means; means for applying suction to the tunnel which thereby draws the leading edge portion of the sheet material when released from the holding means into said tunnel where it is to be deposited upon the conveyor; and valve means for controlling the air flow attendant to release of the article by the holding means, so that the leading edge portion of the article is sucked inwardly into the tunnel to drop upon the conveyor.

2. A laundry feeding machine as claimed in claim 1 wherein the holding means comprises a suction box mounted above the conveyor and having a grill, whereby air is drawn through the grill and a laundry article is held against the grill by suction.

3. A laundry feeding machine as claimed in claim 2 wherein said valve means comprises a single valve operable between first and second valving conditions and disposed from providing suction into the tunnel in said first condition and for providing suction through the grill in said second condition, whereby when suction through the grill is cut off to drop the article, suction is applied to the tunnel to draw the article in.

4. A laundry feeding machine as claimed in claim 1 wherein a movable air seal device is provided to significantly impede air flow from the rear of the tunnel and to cooperate with the conveyor to restrict the entry of air and yet allow the exit of laundry articles.

5. A laundry feeding machine as claimed in claim 4 wherein the air seal device is a roller which rests on the conveyor to form a rolling seal therewith.

6. A laundry feeding machine as claimed in claim 4 wherein the air seal device is a hinged plate movable from a raised position where it is clear of the conveyor to a sealing position where in contacts the conveyor.

7. A laundry feeding machine as claimedin claimed 6 wherein the plate is spring-loaded to the raised position and is drawn down to the sealing position by suction when suction is applied to the tunnel.

8. A laundry feeding machine as claimed in claim 1 wherein the suction device comprises a suction fan coupled to a suction chamber above the conveyor, the suction chamber constituting the roof of the tunnel.

9. A laundry feeding machine as claimed in claim 1, wherein the suction device comprises a suction fan coupled to a suction chamber beneath the conveyor, the conveyor being configured so as to allow the passage of air therethrough and the suction chamber constituting the floor of the tunnel.

10. A laundry feeding machine as claimed in claim 1, wherein a spreader device is provided to spread the laundry articles sideways as they are drawn by the conveyor.

11. A laundry feeding machine as claimed in claim 10 wherein the spreader device includes a spreading plate having a spreading edge disposed to spreadingly engage the article as it moves along the conveyor.

12. A laundry feeding machine as claimed in claim 11 further including means for directing a smoothing suction from the suction device so as to draw the trailing part of the laundry article aganist said spreading edge of said spreading plate, said smooth ing suction maintaining the remainder of the article in a streaming condition sucked away from said conveyor prior to engagement of said remainder with said spreading edge.

13. A laundry feeding machine as claimed in claim 12 further including engaging means for securing sequential portions of each article to said conveyor as said article moves past a given point beyond said spreading plate, smoothing suction control means for initiating and terminating said smoothing suction, passage sensing measn for sensing thed passage of the leading and trailing edges of an article passing along said conveyor before said leading edge is secured by said engaging means, and wherein said smoothing suction control means includes predicting timing control means responsively coupled to said passage sensing means for initiating said smoothing suction at a first predicted later time after passing said passage sensing means when said leading edge will be so secured and to terminate said smoothing suction at a second predicted later time when said trailing edge will have passed beyond said spreading plate.

14. The feeding machine of claim 12 wherein said spreading plate is disposed above said conveyor and said suction-applying means sucks said remainder of said article upward from said conveyor.

15. The laundry feeding machine of claim 14 wherein said timing control means includes a digital computer programmed to compute said predicted later times based upon said passage sensings.

16. A laundry feeding machine as claimed in claim 1 including means for selectively dividing the tunnel, conveyor and loading station into sub-tunnel, conveyor and loading sections of selective widths to accommodate laundry of different sizes, each sub-tunnel section and loading station section having independently controlled valve means which allow independent suction and load station release cycles to be applied to the different sub-tunnels and loading station sections.

17. The laundry feeding machine of claim 1 further including tunnel suction control means which terminates suction in the air tunnel after the leading edge portion of the sheet material is drawn into the tunnel.

18. The laundry feeding machine of claim 1 or 17, wherein there is provided a sheet feeding material sensing means and associated control means responsive to the draping of a sheet across the front of the air tunnel for effecting automatic release of the leading edge portion of the sheet material from the holding means to establish release of the leading edge portion of the sheet material and to initiate suction in the air tunnel when the sheet material is draped over the front of the air tunnel.

19. The feeding machine of claim 1 wherein said holding means includes releasably operable clamping means mounted for movement in a direction transverse to the travel axis of said conveyor.

20. The feeding machine of claim 1 further including presence sensing means for sensing the presence of an article disposed on a part of said conveyor proximate to said air tunnel front, and releasing control means responsively coupled to said presence sensing means for operating said holding means to a released condition, said releasing control means including means for inhibiting operation of said holding means to said releasing condition responsively to a sensing of the presence of an article by said presence sensing means.

21. A spreader device for sideways spreading of laundry articles as they are drawn by conveyor means of a laundry feeding machine, comprising:

engaging means for securing sequential portions of each article to said conveyor means as said article moves past a given point;

spreading plate means including a blade with an edge, said edge being disposed proxmiate to said conveyor means and disposed in a confronting relationship to a passing article before it passes said given point;

air flow generating means for generating an air flow oriented to liftingly stream a trailing portion of said article off of said conveyor means and into progressive tensioned contact along its length with said spreading plate edge as said article is moved by said conveyor, said edge being configured to exert a sideways spreading action on said article, said air flow being directed to maintain the remainder of the article away from said conveyor means in a streaming condition prior to engagement with said blade edge;

control means for initiating said air flow after a leading edge of said article has been secured by said engaging means and for terminating said air flow after a trailing edge of said article has passed beyond said blade edge.

22. The spreader device of claim 21 wherein said spreading plate means includes a generally planar member bearing said edge thereon, and said conveyor means includes aperture means for allowing air to stream generally therethrough toward said blade under the influence of said air flow generating means.

23. The spreader device of claim 22 wherein said engaging means includes a nip roller.

24. The spreader device of claim 21 wherein said air flow generating means includes a chamber controllably coupled to a suction means and having an aperture disposed to confront passing articles so that the trailing portions of said articles are sequentially sucked into said chamber, one boundary of said aperture being defined by said edge of said spreading plate means, said edge being positioned so that said trailing portions are slidingly smoothingly drawn against said edge by said engaging means against the force produced by said suction means.

25. The spreader device of claims 21, 22, or 24 or 24 wherein said spreading plate edge is disposed above said conveyor means and said air flow generating means is configured to blow said trailing portion of said article upward from said conveyor means.

26. The spreader device of claim 21 or 24 further including passage sensing means for sensing the passage of the leading and trailing edges of an article passing along said conveyor means before said leading edge is secured by said engaging means, and wherein said control means includes predicting timing control means responsively coupled to said passage sensing means for initiating said air flow at a predicted first later time after passing said passage sensing means when said leading edge will be so secured and to terminate said air flow at a predicted second later time when said trailing edge will have passed beyond said spreading plate edge.

27. The spreader device of claim 26 wherein said passage timing control means includes a digital computer programmed to compute said predicted later times based upon said sensings.

28. The spreader device of claim 24 wherein said engaging means includes a nip roller.

29. The spreader device of claim 22, 23, 24 or 28 wherein said edge is configured as a portion of a circular arc.

* * * * *

UNITED STATES PATENT OFFICE
CERTIFICATE OF CORRECTION

PATENT NO. : 4,729,181

DATED : March 8, 1988

INVENTOR(S) : Henry J. Weir

It is certified that error appears in the above-identified patent and that said Letters Patent are hereby corrected as shown below:

In Column 1, line 6, the number appearing as "647,842" should read --697,842--.

In Column 3, lines 17-18, the words appearing as "suc-tioninduced" should read --suc-tion induced--.

In Column 3, lines 31-32, the words appearing as "mini-computersteere" should read --mini-computer steered--.

In Column 5, line 27, the word appearing as "cham-ber" should read --chamber--.

In Column 12, line 13, the word appearing as "from" should read --for--.

In Column 12, line 29, the word appearing as "in" should read --it--.

In Column 12, line 30, the word appearing as "claimedin" should read --claimed in--.

In Column 12, line 30, the word appearing as "claimed" should read --claim--

In Column 12, line 55, the word appearing as "aganist" should read --against--.

UNITED STATES PATENT OFFICE

CERTIFICATE OF CORRECTION

PATENT NO. : 4,729,181

DATED : March 8, 1988

INVENTOR(S) : Henry J. Weir

It is certified that error appears in the above-identified patent and that said Letters Patent are hereby corrected as shown below:

In Column 12, line 56, the word appearing as "smooth ing" should read --smoothing--.

In Column 12, line 66, the word appearing as "measn" should read --means--.

In Column 12, line 66, the word appearing as "thed" should read --the--.

In Column 14, line 38, the second appearance of "or 24" should be deleted.

Signed and Sealed this

Eleventh Day of October, 1988

*Attest:*

DONALD J. QUIGG

*Attesting Officer*

*Commissioner of Patents and Trademarks*